US011484774B2

(12) United States Patent
Dulcamara et al.

(10) Patent No.: US 11,484,774 B2
(45) Date of Patent: Nov. 1, 2022

(54) HEEL UNIT WITH CLIMBING AID FOR AN ALPINE TOURING BINDING

(71) Applicant: Salewa Sport AG, Denges (CH)

(72) Inventors: Matthew Dulcamara, Aschheim (DE); Uwe Eckart, Aschheim (DE); Edwin Lehner, Aschheim (DE)

(73) Assignee: Salewa Sport AG, Denges (CH)

( * ) Notice: Subject to any disclaimer, the term of this patent is extended or adjusted under 35 U.S.C. 154(b) by 20 days.

(21) Appl. No.: 17/144,921

(22) Filed: Jan. 8, 2021

(65) Prior Publication Data

US 2021/0213349 A1 Jul. 15, 2021

Related U.S. Application Data

(63) Continuation-in-part of application No. 17/144,668, filed on Jan. 8, 2021, now abandoned.

(30) Foreign Application Priority Data

Jan. 9, 2020 (DE) ..... 10 2020 200 181.2

(51) Int. Cl.
*A63C 13/00* (2006.01)
*A63C 9/08* (2012.01)

(52) U.S. Cl.
CPC ..... *A63C 13/001* (2013.01); *A63C 9/0807* (2013.01); *A63C 13/003* (2013.01); *A63C 13/005* (2013.01); *A63C 13/006* (2013.01); *A63C 13/008* (2013.01)

(58) Field of Classification Search
CPC ..... A63C 9/006; A63C 9/0807; A63C 13/001; A63C 13/003; A63C 13/005; A63C 13/006; A63C 13/008
See application file for complete search history.

(56) References Cited

U.S. PATENT DOCUMENTS

| | | | | |
|---|---|---|---|---|
| 2011/0018232 | A1* | 1/2011 | Prigge | A63C 9/0807 280/617 |
| 2011/0049821 | A1* | 3/2011 | Trabucchi | A43B 5/0496 280/11.33 |
| 2014/0070519 | A1* | 3/2014 | Fritschi | A63C 9/086 280/623 |
| 2016/0089592 | A1* | 3/2016 | Damiani | A63C 9/006 280/611 |
| 2017/0056755 | A1* | 3/2017 | Lapierre | A63C 7/108 |
| 2017/0209769 | A1* | 7/2017 | Fritschi | A63C 9/0846 |

(Continued)

*Primary Examiner* — Jeffrey J Restifo
(74) *Attorney, Agent, or Firm* — Kilpatrick Townsend & Stockton LLP

(57) ABSTRACT

A heel unit for an alpine touring binding, comprising a binding body which is suitable for holding a heel portion of an alpine touring shoe in a downhill position of the heel unit and for releasing the heel portion of the alpine touring shoe in an alpine touring position of the heel unit, such that the alpine touring shoe can lift off the heel unit, and a climbing aid which is adjustable between an active position and a passive position, wherein, while in the active position, the climbing aid supports the heel portion of the alpine touring shoe at a predetermined height above a sliding board plane in the alpine touring position of the heel unit, wherein the climbing aid is biased over the entire path of movement thereof into the active position by means of a flexible element and can be locked in the passive position.

13 Claims, 9 Drawing Sheets

(56) References Cited

U.S. PATENT DOCUMENTS

Figure 1:
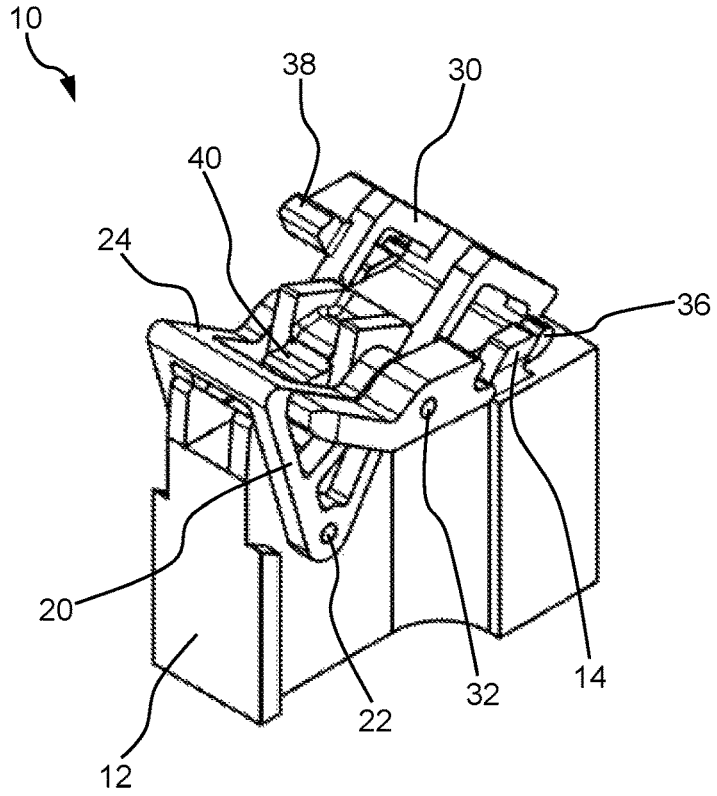

| | | | | |
|---|---|---|---|---|
| 2017/0209770 | A1* | 7/2017 | Kreuzinger | A63C 9/0841 |
| 2017/0209771 | A1* | 7/2017 | Kreuzinger | A63C 7/1046 |
| 2019/0126131 | A1* | 5/2019 | Shute | A63C 9/0807 |
| 2021/0213348 | A1* | 7/2021 | Dulcamara | A63C 9/006 |
| 2021/0213349 | A1* | 7/2021 | Dulcamara | A63C 13/005 |
| 2021/0283491 | A1* | 9/2021 | Dulcamara | A63C 9/086 |
| 2021/0308552 | A1* | 10/2021 | Lehner | A63C 9/002 |

* cited by examiner

HEEL UNIT WITH CLIMBING AID FOR AN ALPINE TOURING BINDING

CROSS-REFERENCE TO RELATED APPLICATIONS

This application is a continuation in part of U.S. patent application Ser. No. 17/144,668 filed Jan. 8, 2021, which claims priority to German Patent Application No. DE 10 2020 200 181.2 filed on Jan. 9, 2020, the entire contents of both such applications are hereby incorporated herein by this reference.

DESCRIPTION

The present invention relates to a heel unit for an alpine touring binding, comprising a binding body which is suitable for holding a heel portion of an alpine touring shoe in a downhill position of the heel unit and for releasing the heel portion of the alpine touring shoe in an alpine touring position of the heel unit, such that the alpine touring shoe can lift off the heel unit, and a climbing aid which is adjustable between an active position and a passive position, wherein, while in the active position, the climbing aid supports the heel portion of the alpine touring shoe at a predetermined height above a sliding board plane in the alpine touring position of the heel unit. Furthermore, the present invention relates to a heel unit for an alpine touring binding, comprising a binding body which is suitable for holding a heel portion of an alpine touring shoe in a downhill position of the heel unit and for releasing the heel portion of the alpine touring shoe in an alpine touring position of the heel unit, such that the alpine touring shoe can lift off the heel unit, a first climbing aid which is adjustable between an active position and a passive position, wherein, while in the active position, the first climbing aid supports the heel portion of the alpine touring shoe at a predetermined height above a sliding board plane in the alpine touring position of the heel unit, and a second climbing aid which is adjustable between an active position and a passive position, wherein, while in the active position, the second climbing aid supports the heel portion of the alpine touring shoe at a predetermined height above a sliding board plane in the alpine touring position of the heel unit, which height is higher than the predetermined height of the first climbing aid.

Such heel units are known. A climbing aid is used in ski mountaineering to compensate for changes in the slope of the terrain while walking. Steep terrain can be compensated for by activating the climbing aid and thus increasing the support height for a heel portion of an alpine touring shoe. In conventional alpine touring bindings, one or two climbing aids are often provided, such that, in addition to a so-called zero position, in which no climbing aid is activated and a heel portion of the alpine touring shoe rests directly on a ski, a base, or a brake pedal of the heel unit of the alpine touring binding, one or two further support heights can be set by the user by adjusting the climbing aid from a passive position into an active position.

Often, the climbing aid is pivotably mounted on the binding body of the heel unit and, in order to be adjusted from the passive position into the active position, has to be pivoted into the active position by the user, by hand or using a ski pole. In this case, the user has to guide the climbing aid, in particular by pulling using a ski pole, over the entire movement path or a large part of the movement path from the passive position into the active position. In particular in adverse conditions, which often prevail when ski mountaineering in the form of ice and snow, this adjustment can be quite difficult, also because climbing aids are constructed of increasingly smaller and more difficult-to-grip components due to weight savings.

For example, if two climbing aids are provided, the second climbing aid is often also pivotably mounted on the binding body, preferably on the same shaft as the first climbing aid. The above-mentioned problems therefore also arise when adjusting the second climbing aid from the passive position into the active position. In the case of two climbing aids, a further disadvantage can be that, during an intended adjustment of the first climbing aid from the passive position into the active position by the user, also the second climbing aid is accidentally gripped and adjusted and therefore the correct support height for the heel portion of the alpine touring shoe is not found straight away.

Heel units with other types of climbing aids are also known, all of which, however, are either difficult to operate or have arrangements which are complex, relatively heavy and/or expensive to manufacture, for example pneumatically, hydraulically and/or electronically operating arrangements.

Against this background, it is an object of the present invention to provide a heel unit for an alpine touring binding, which allows a simplified operation of one or, if necessary, a plurality of climbing aids, which is comparatively simple in construction and is lightweight.

According to a first aspect of the present invention, the object on which the invention is based is achieved by a heel unit for an alpine touring binding, comprising a binding body which is suitable for holding a heel portion of an alpine touring shoe in a downhill position of the heel unit and for releasing the heel portion of the alpine touring shoe in an alpine touring position of the heel unit, such that the alpine touring shoe can lift off the heel unit, and a climbing aid which is adjustable between an active position and a passive position, wherein, while in the active position, the climbing aid supports the heel portion of the alpine touring shoe at a predetermined height above a sliding board plane in the alpine touring position of the heel unit, wherein the climbing aid is biased over the entire path of movement thereof into the active position by means of a flexible element and can be locked in the passive position.

If the climbing aid is biased into the active position over the entire movement path and can additionally be locked in the passive position, it is sufficient, for the adjustment of the climbing aid from the locked, passive position into the active position, to release this locking in order to achieve an adjustment. The climbing aid therefore no longer has to be guided over the entire path of movement thereof or over part of the movement path; it is sufficient to release a locking mechanism, which can be present as a latching mechanism or hook mechanism, for example. All locking options are conceivable in this case. In particular, the locking can be released by pressing on the climbing aid using a ski pole, for example. By biasing the climbing aid into the active position, the climbing aid moves automatically into the active position after releasing the locking. The adjustment of the climbing aid is carried out semi-automatically, so to speak, and the operation of the climbing aid is advantageously simplified.

In a preferred embodiment of the first aspect of the invention, the climbing aid can be pivotably mounted on the heel unit, in particular on the binding body. A pivotable design of the climbing aid can bring the advantages of ease of use and the option of a space-saving arrangement. The bias into the active position can advantageously be achieved by means of a leg spring as a flexible element, which requires less installation space compared to other springs, such as compression springs or tension springs.

Alternatively, however, the climbing aid can also be arranged so as to be linearly displaceable on the heel unit, in particular on the binding body. In particular, a climbing aid that is longitudinally displaceable in the ski direction is conceivable, which, after releasing the locking, can be pushed forwards in a simple manner in order to be brought into the active position. The operation of a longitudinally displaceable climbing aid is also very easy.

In particular, the climbing aid can be a first climbing aid and the heel unit can furthermore comprise a second climbing aid which is adjustable between an active position and a passive position, wherein, while in the active position, the second climbing aid supports the heel portion of the alpine touring shoe at a predetermined height above a sliding board plane in the alpine touring position of the heel unit, which height is higher than the predetermined height of the first climbing aid.

In this case, the second climbing aid can be mounted on the first climbing aid. Such an arrangement can in turn advantageously simplify the operation of the climbing aids. In addition, if the second climbing aid is mounted on a shaft which is relatively far away from the ski, it can be designed to be smaller and therefore lighter, since, proceeding from the high point on the first climbing aid, less additional height is necessary for the support surface of the second climbing aid.

In addition, if two climbing aids are provided, the first climbing aid can be locked in the passive position by means of the second climbing aid. In this way, both climbing aids can advantageously be locked in the passive position by means of only one locking mechanism.

In a particularly advantageous embodiment of the first aspect of the present invention, the first climbing aid and/or the flexible element can be configured to transfer the second climbing aid into a standby position during the adjustment of the first climbing aid from the passive position into the active position, the standby position being located between the passive position and the active position of the second climbing aid. If the first climbing aid drives the second climbing aid during the adjustment of the first climbing aid from the passive position into the active position over a section of the movement path, i.e. transfers the second climbing aid into a standby position, a shortened path has to be overcome for the adjustment of the second climbing aid into the active position. In addition, the second climbing aid can protrude from the heel unit or from the binding body in the standby position and thus be easier to grip or operate, while in the passive position it can advantageously abut close to the binding body. In this way, the operation of the second climbing aid can be simplified in that it is transferred to the standby position during the adjustment of the first climbing aid.

If two climbing aids are provided, the flexible element can preferably provide a spring force both for the first climbing aid and for the second climbing aid. Thus, only one spring is required for both climbing aids, and costs and weight can be saved. In particular, the flexible element can transmit the spring force for the first climbing aid directly by being arranged on the first climbing aid, and can transmit the spring force for the second climbing aid indirectly by being arranged on the first climbing aid and by transmitting the spring force via the first climbing aid to the second climbing aid. The second climbing aid can be biased into the active position, for example, by means of the flexible element. In addition, the second climbing aid can assume a stable position in the standby position, in particular due to the interaction of a mating surface of the second climbing aid with a mating surface of the binding body or the like and the flexible element. The exact position of the standby position can be set by an angle of the mating surface of the binding body.

According to a second aspect of the present invention, the object on which the invention is based is achieved by a heel unit for an alpine touring binding, comprising a binding body which is suitable for holding a heel portion of an alpine touring shoe in a downhill position of the heel unit and for releasing the heel portion of the alpine touring shoe in an alpine touring position of the heel unit, such that the alpine touring shoe can lift off the heel unit, a first climbing aid which is adjustable between an active position and a passive position, wherein, while in the active position, the first climbing aid supports the heel portion of the alpine touring shoe at a predetermined height above a sliding board plane in the alpine touring position of the heel unit, and a second climbing aid which is adjustable between an active position and a passive position, wherein, while in the active position, the second climbing aid supports the heel portion of the alpine touring shoe at a predetermined height above a sliding board plane in the alpine touring position of the heel unit, which height is higher than the predetermined height of the first climbing aid, wherein the first climbing aid is configured to transfer the second climbing aid into a standby position during the adjustment of the first climbing aid from the passive position into the active position, the standby position being located between the passive position and the active position of the second climbing aid.

If the first climbing aid drives the second climbing aid during the adjustment of the first climbing aid from the passive position into the active position over a section of the movement path, i.e. transfers the second climbing aid into a standby position, a shortened path has to be overcome for the adjustment of the second climbing aid into the active position. In addition, the second climbing aid can protrude from the heel unit or from the binding body in the standby position and thus be easier to grip or operate, while in the passive position it can advantageously abut close to the binding body. In this way, the operation of the second climbing aid is simplified in that it is transferred to the standby position during the adjustment of the first climbing aid.

In an embodiment of the second aspect of the present invention, the first climbing aid can be pivotably mounted on the heel unit, in particular on the binding body. A pivotable design of the climbing aid can bring the advantages of ease of use and the option of a space-saving arrangement. The bias into the active position can advantageously be achieved by means of a leg spring as a flexible element, which requires less installation space compared to other springs, such as compression springs or tension springs.

In an alternative embodiment of the second aspect of the present invention, the first climbing aid can be mounted on the heel unit, in particular on the binding body, so as to be linearly displaceable. In particular, a climbing aid that is longitudinally displaceable in the ski direction is conceivable, which, after releasing the locking, can be pushed forwards in a simple manner in order to be brought into the active position. The operation of a longitudinally displaceable climbing aid is also very easy.

Particularly preferably, the second climbing aid can be mounted on the first climbing aid. Such an arrangement can in turn advantageously simplify the operation of the climbing aids. In addition, if the second climbing aid is mounted on a shaft which is relatively far away from the ski, it can be designed to be smaller and therefore lighter, since, proceeding from the high point on the first climbing aid, less additional height is necessary for the support surface of the second climbing aid.

In a particularly advantageous embodiment of the second aspect of the present invention, the first climbing aid can be biased over the entire path of movement thereof into the active position by means of a flexible element and can be locked in the passive position. If the first climbing aid is biased into the active position over the entire path of movement thereof and can additionally be locked in the passive position, it is sufficient, for the adjustment of the climbing aid from the locked, passive position into the active position, to release this locking in order to achieve an adjustment. The first climbing aid no longer has to be guided over the entire path of movement thereof or over part of said movement path; it can be sufficient to release a locking mechanism, which can be present as a latching mechanism or hook mechanism, for example. All locking options are conceivable in this case. In particular, the locking can be released by pressing on the climbing aid using a ski pole, for example. By biasing the first climbing aid into the active position, the first climbing aid can move automatically into the active position after releasing the locking. The adjustment of the first climbing aid can take place semi-automatically, so to speak, and the operation of the climbing aid can be further simplified.

The flexible element can provide a spring force both for the first climbing aid and for the second climbing aid. In particular, the flexible element can transmit the spring force for the first climbing aid directly by being arranged on the first climbing aid, and can transmit the spring force for the second climbing aid indirectly by being arranged on the first climbing aid and by transmitting the spring force via the first climbing aid to the second climbing aid. The second climbing aid can be biased into the active position, for example, by means of the flexible element. In addition, the second climbing aid can assume a stable position in the standby position, in particular due to the interaction of a surface of the second climbing aid with a surface of the binding body or the like and the flexible element. The exact position of the standby position can be set by an angle of the surface of the binding body.

Furthermore, the first climbing aid can be locked in the passive position by means of the second climbing aid. In this way, both climbing aids can advantageously be locked in the passive position by means of only one locking mechanism.

In another embodiment, the first climbing aid can be biased by means of a flexible element and can be configured to pass a center point during the adjustment of the first climbing aid from the passive position into the active position. The center point refers to a point refers to a point that is precisely, e.g. dead center, or substantially at the center of a motion path between the passive position and the active position of the first climbing aid. Such an arrangement with a center point passage of the biased first climbing aid is particularly easy to operate. The first climbing aid is biased by means of the elastic element, either in its passive position or in its active position. If the first climbing aid passes the center point where the flexible element is compressed the most when moving from the passive position towards the active position, it "snaps" into the active position. Conversely, if the first climbing aid passes the center point when moving from the active position towards the passive position, it "snaps" into the passive position. With this embodiment, this highly intuitive operation can further improve user comfort.

Figure 2:
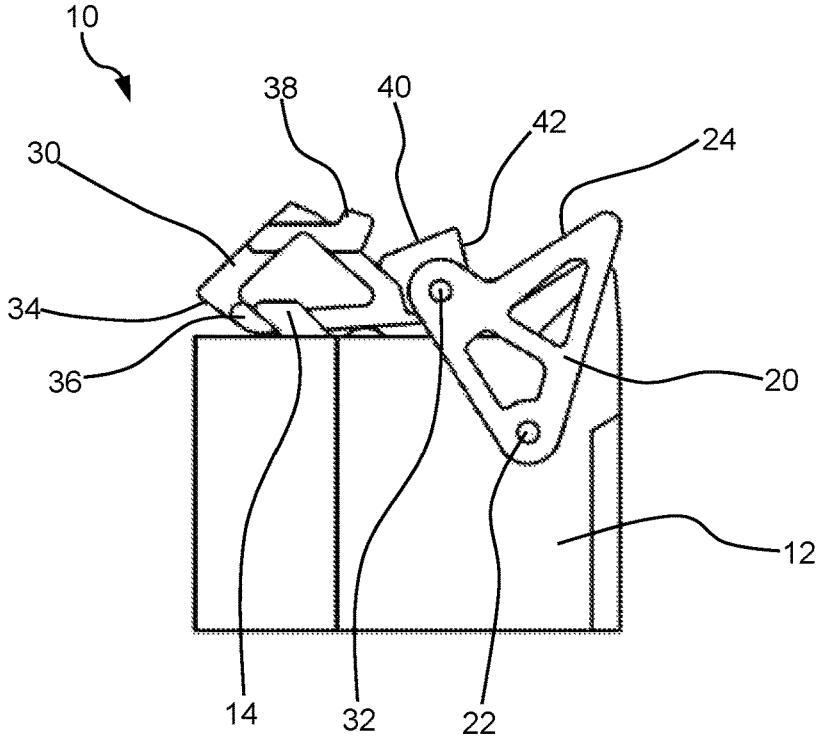
Figure 3:
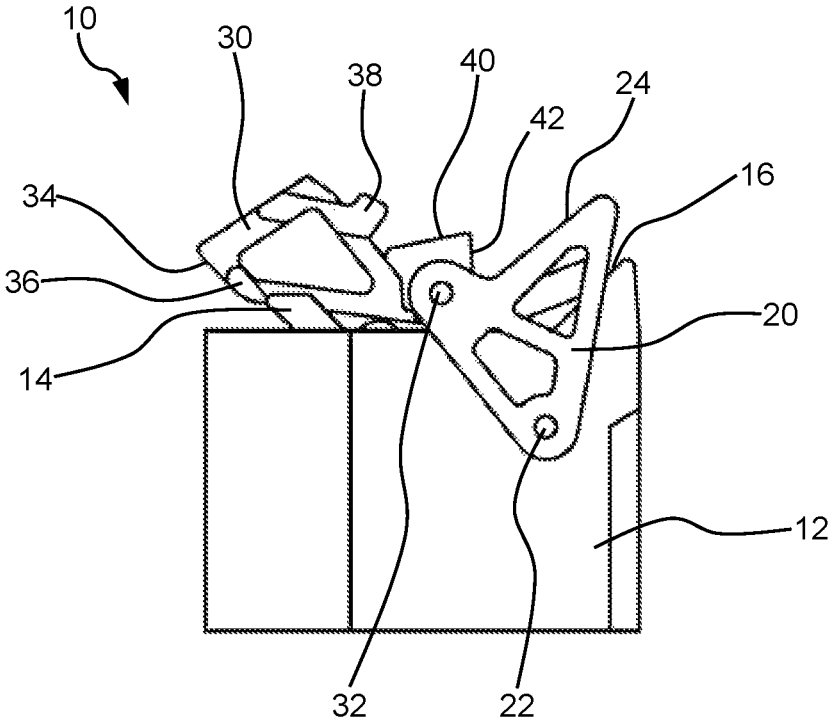
Figure 4:
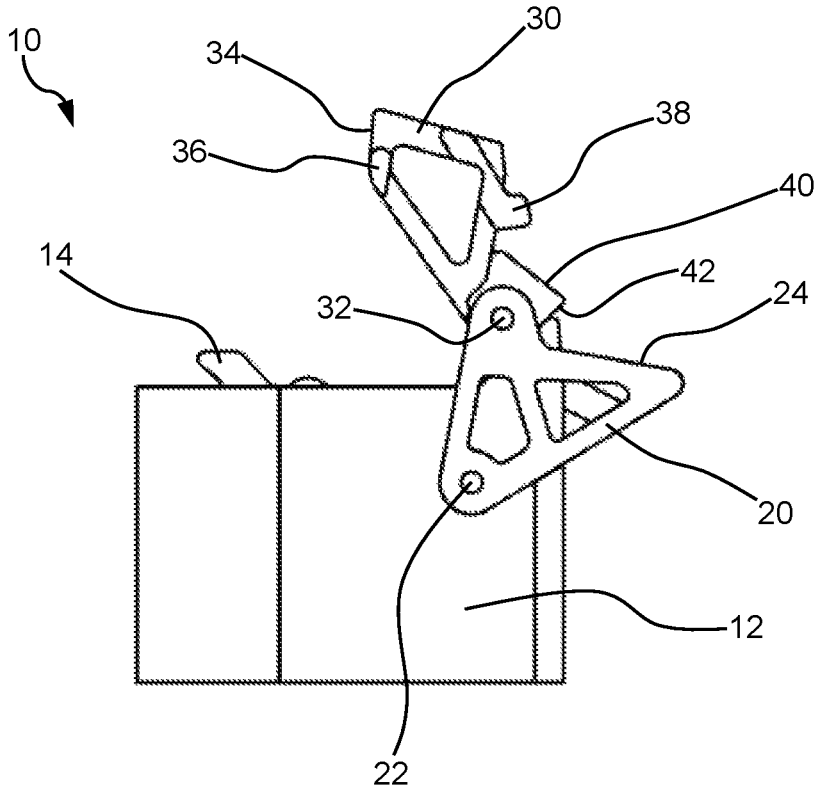
Figure 5:
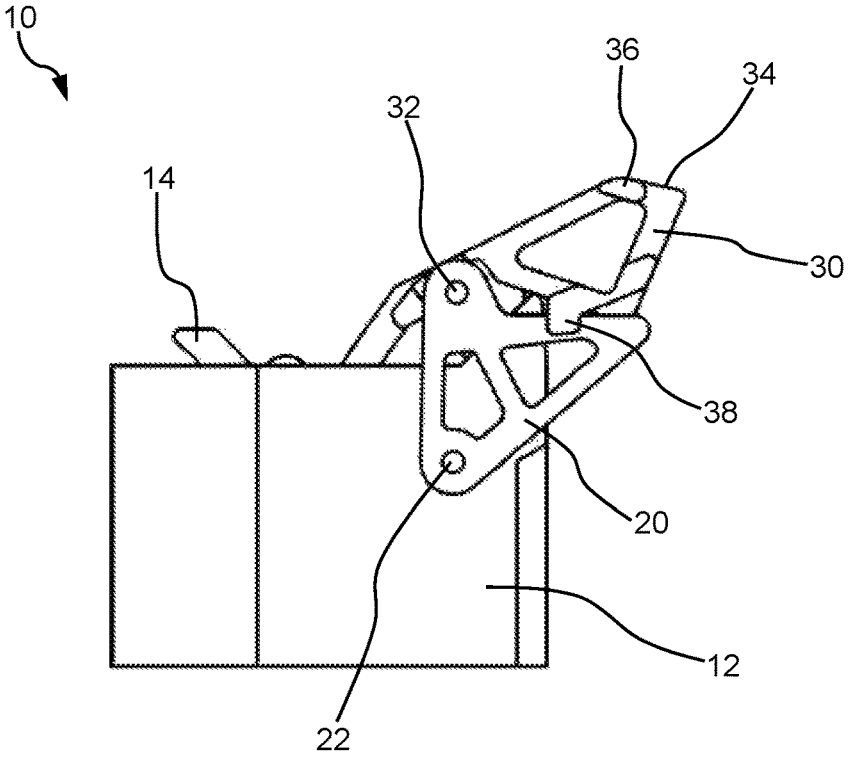
Figure 6:
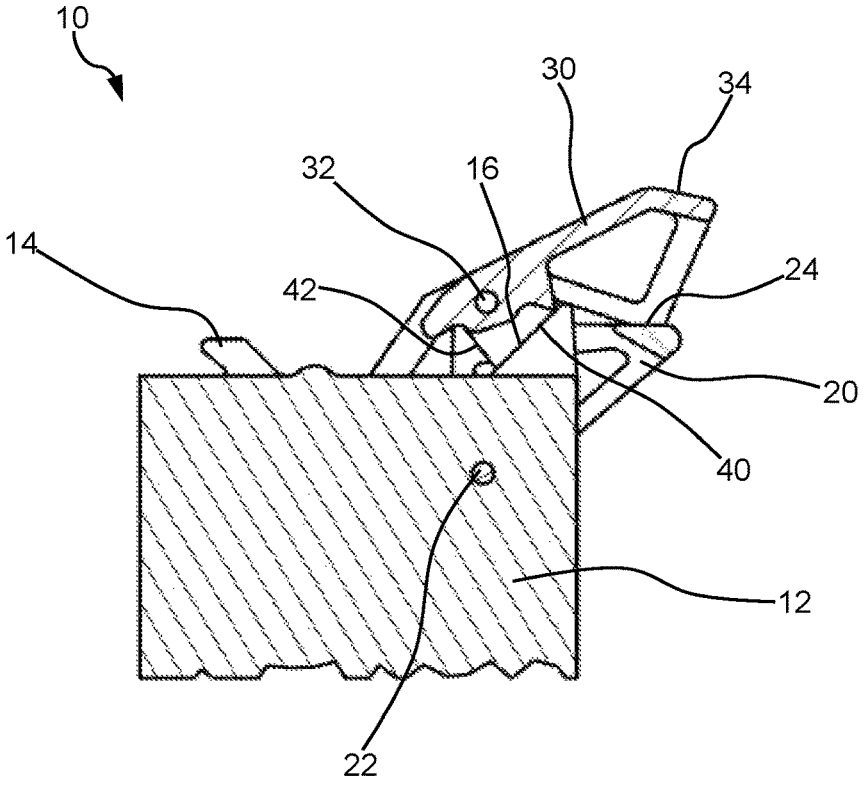
Figure 7:
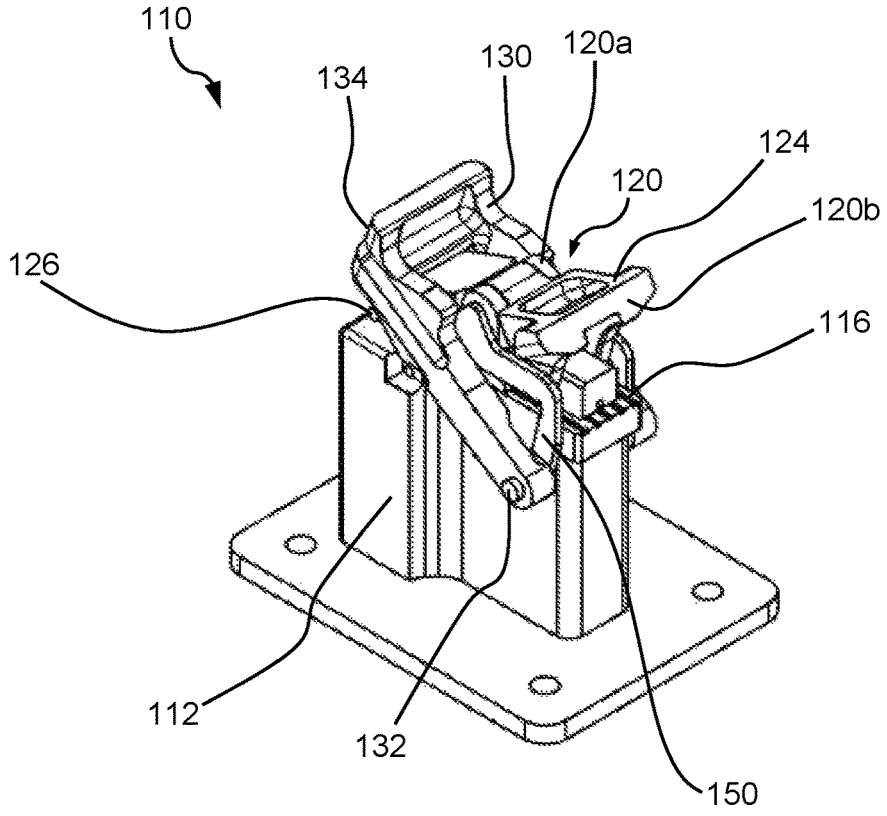
Figure 8:
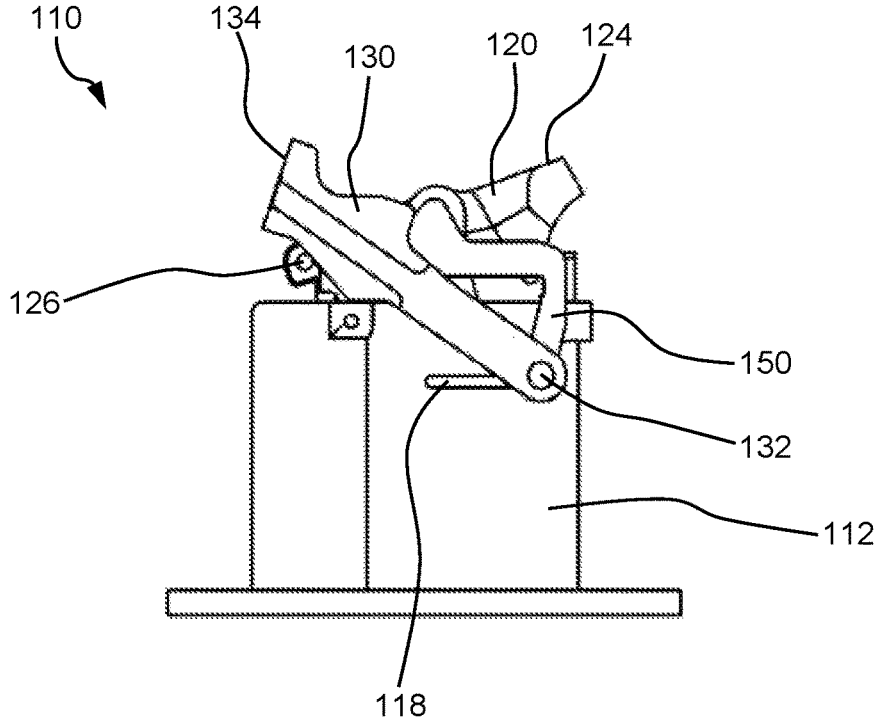
Figure 9:
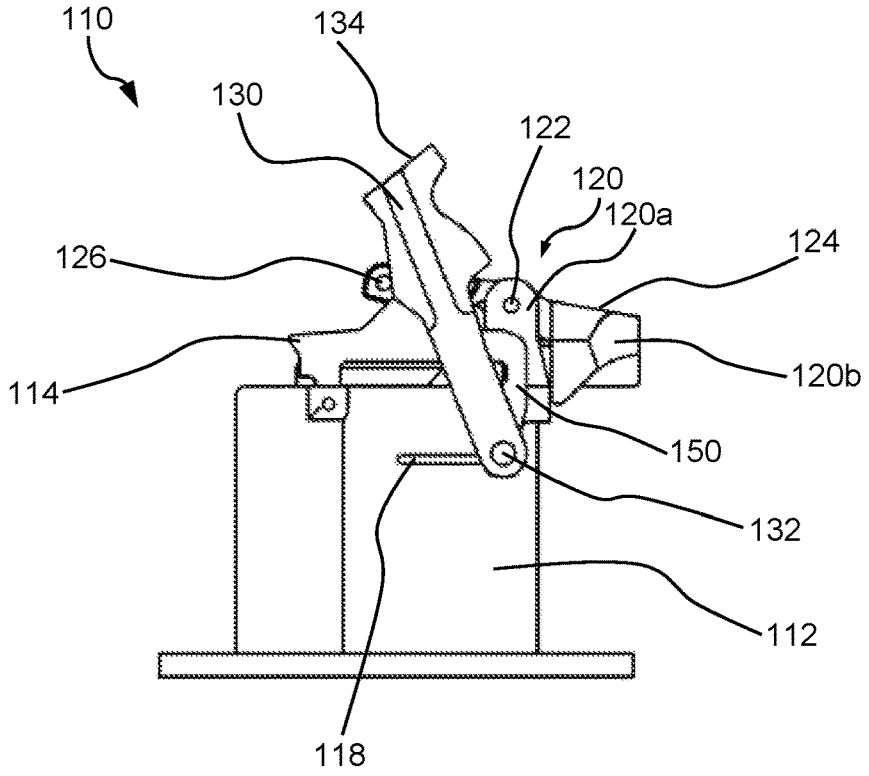
Figure 10:
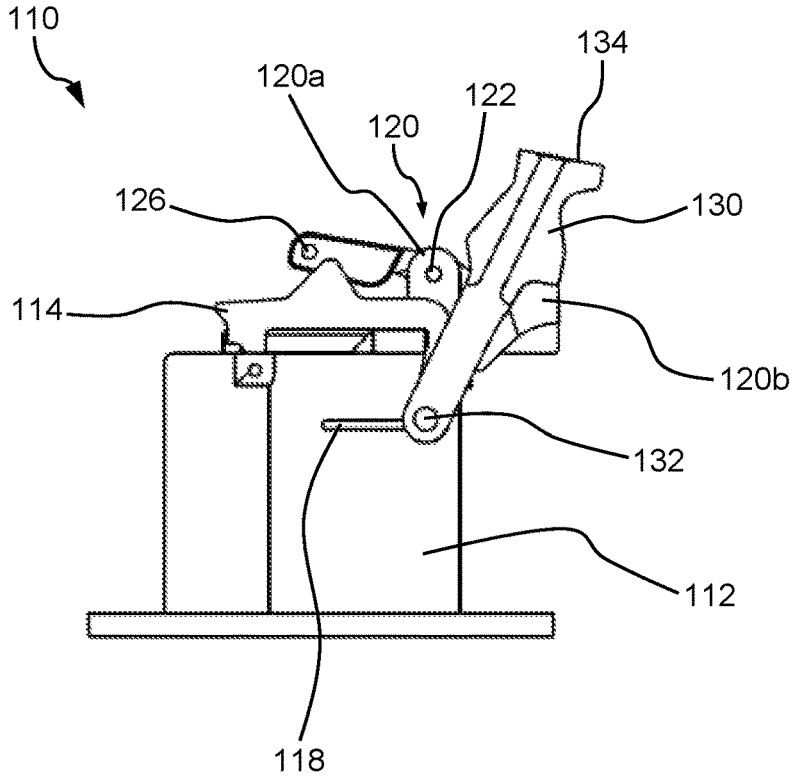
Figure 11:
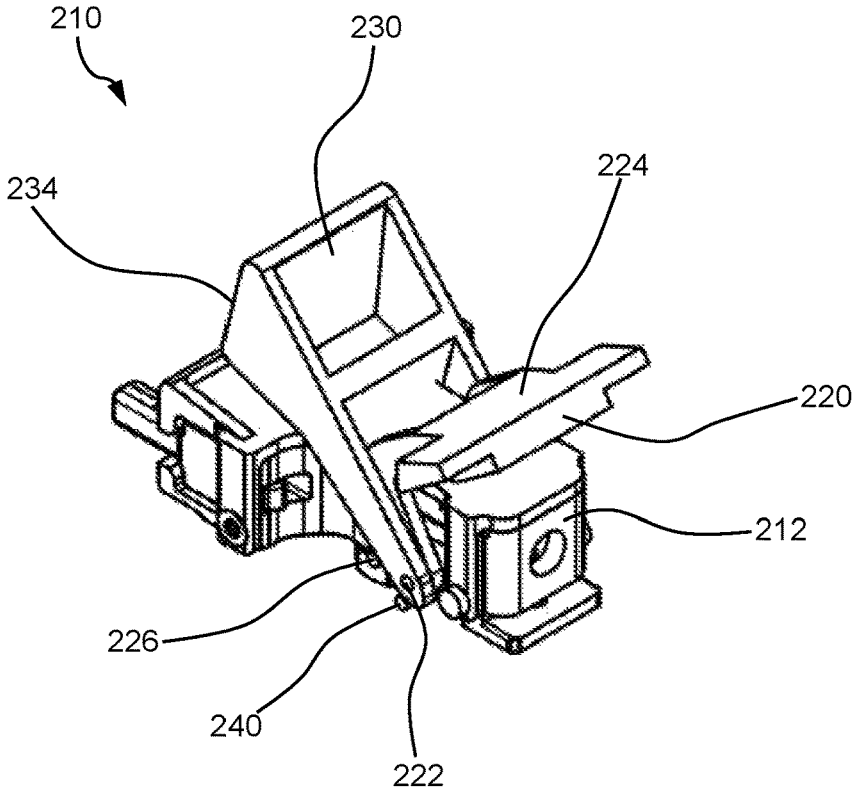
Figure 12:
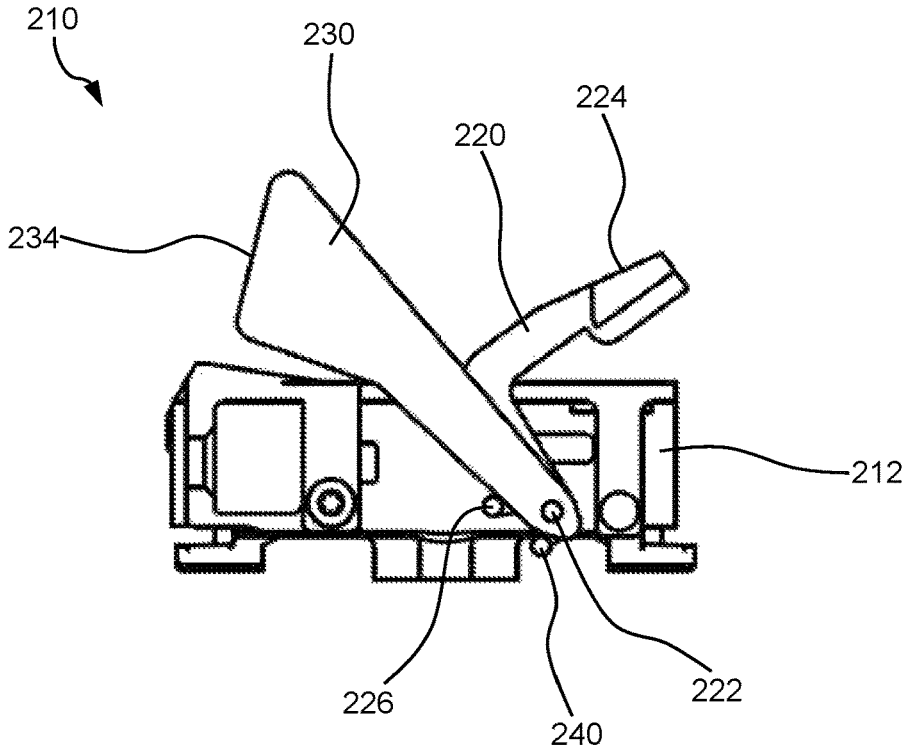
Figure 13:
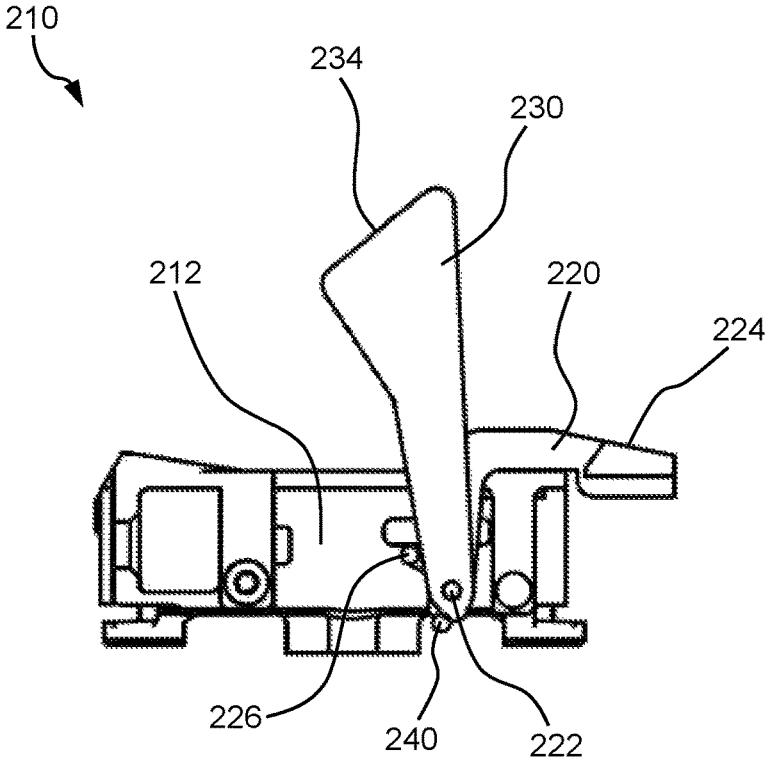
Figure 14:
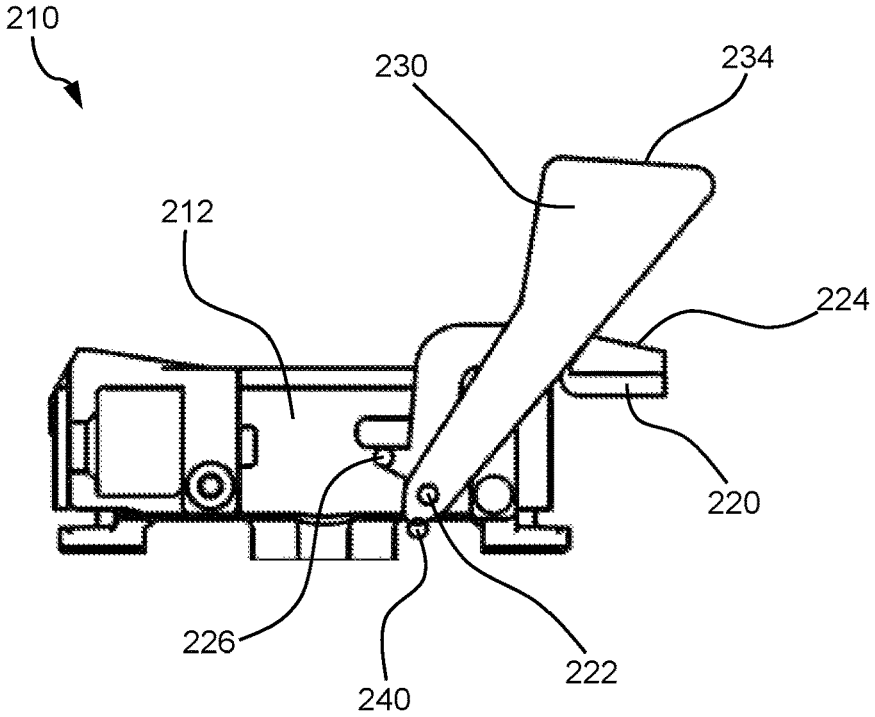
Figure 15:
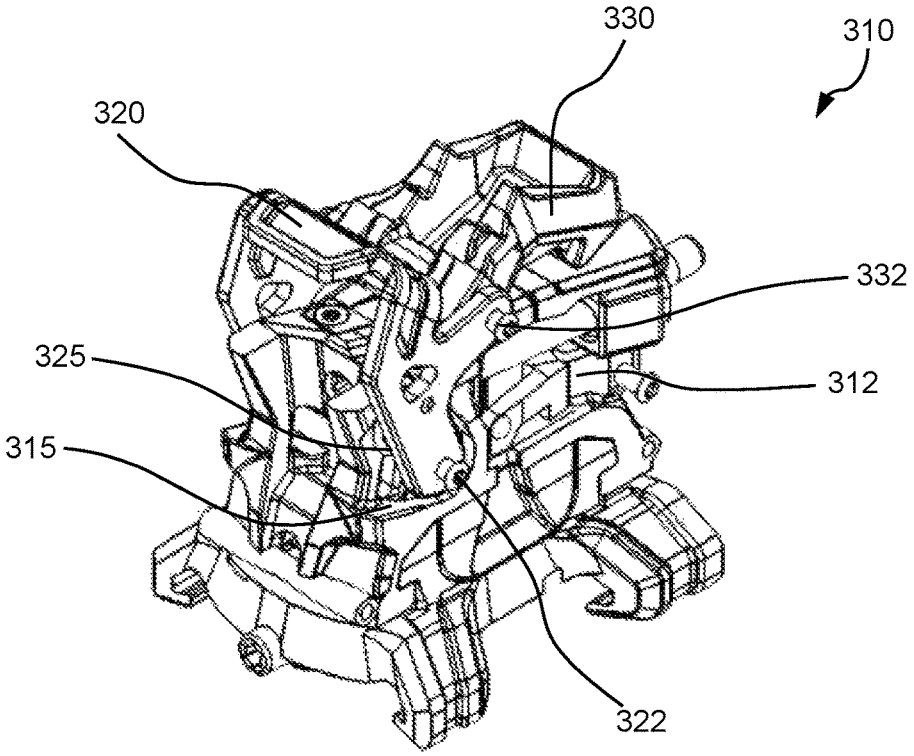
Figure 16:
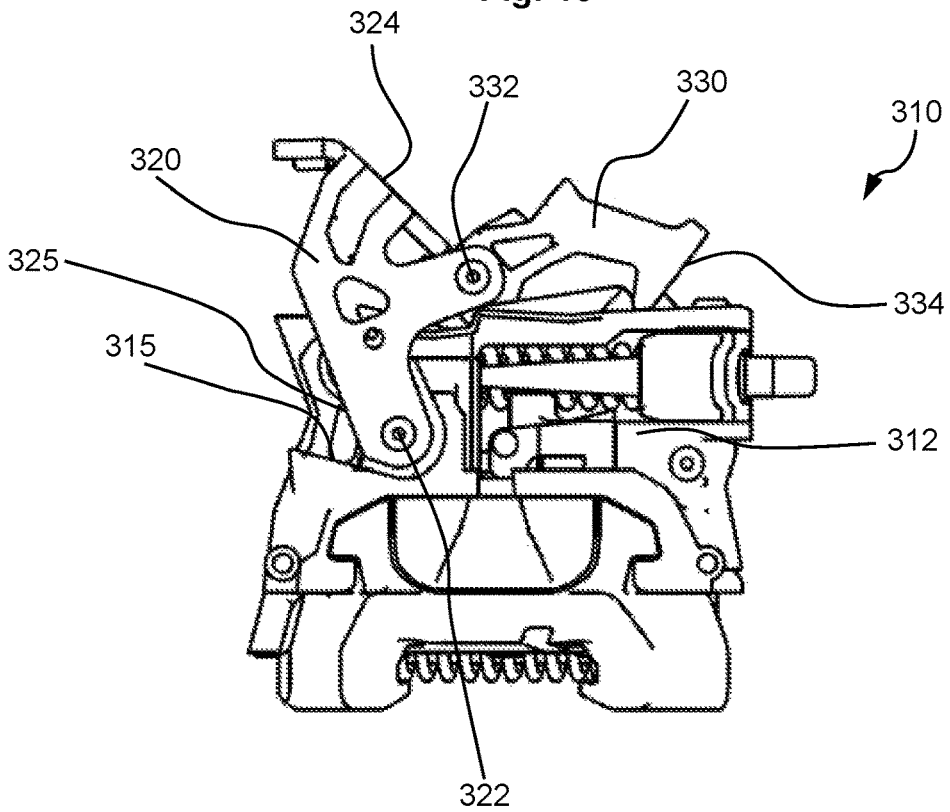
Figure 17:
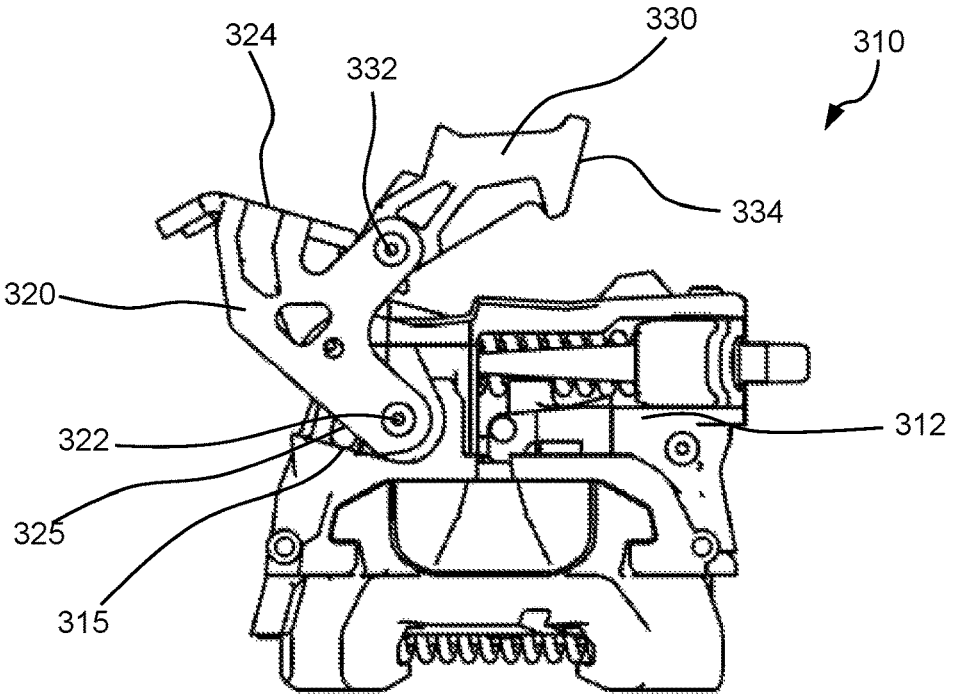
Figure 18:
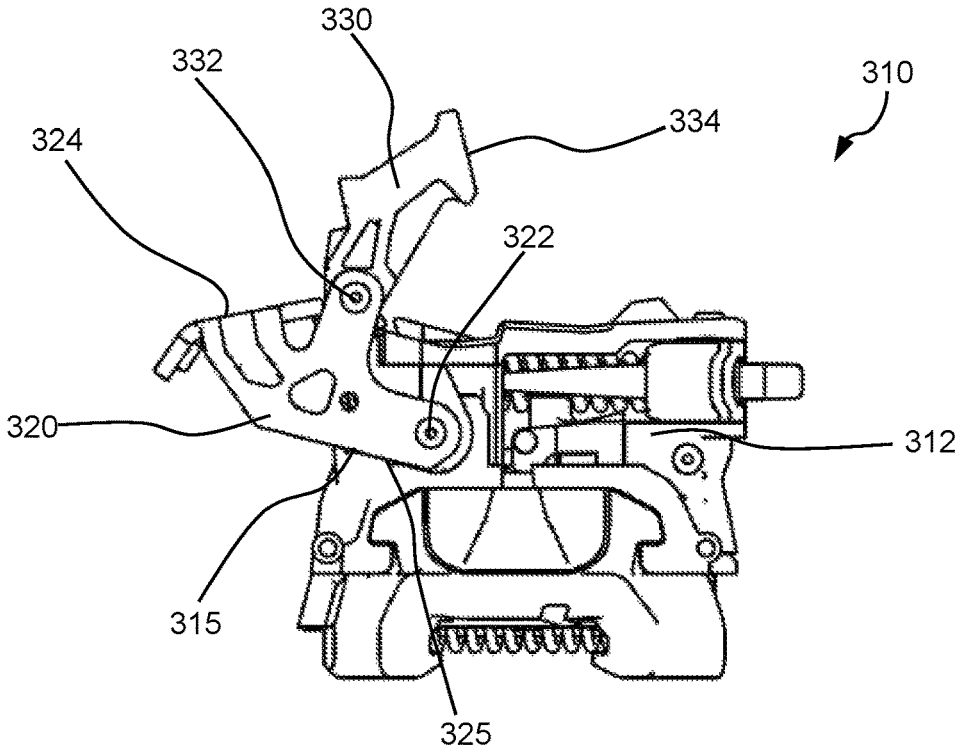

The invention is explained in more detail below on the basis of preferred embodiments of the present invention with reference to the accompanying drawings, in which:

FIG. 1 is a perspective view of a heel unit according to a first embodiment of the present invention with a first climbing aid in a passive position and a second climbing aid in a passive position, FIG. 2 is a side view of the heel unit according to the first embodiment of the present invention with the first climbing aid in the passive position and the second climbing aid in the passive position, FIG. 3 is a side view of the heel unit according to the first embodiment of the present invention with positions of the climbing aids shortly after the passive position of the first climbing aid and the passive position of the second climbing aid during the transition into an active position of the first climbing aid and a standby position of the second climbing aid, FIG. 4 is a side view of the heel unit according to the first embodiment of the present invention with the first climbing aid in the active position and the second climbing aid in the standby position, FIG. 5 is a side view of the heel unit according to the first embodiment of the present invention with the first climbing aid in the active position and the second climbing aid in an active position, FIG. 6 is a sectional view of the heel unit according to the first embodiment of the present invention with the first climbing aid in the active position and the second climbing aid in the active position, FIG. 7 is a perspective view of a heel unit according to a second embodiment of the present invention with a first climbing aid in a passive position and a second climbing aid in a passive position, FIG. 8 is a side view of the heel unit according to the second embodiment of the present invention with the first climbing aid in the passive position and the second climbing aid in the passive position, FIG. 9 is a side view of the heel unit according to the second embodiment of the present invention with the first climbing aid in an active position and the second climbing aid in a standby position, FIG. 10 is a side view of the heel unit according to the second embodiment of the present invention with the first climbing aid in the active position and the second climbing aid in an active position, FIG. 11 is a perspective view of a heel unit according to a third embodiment of the present invention with a first climbing aid in a passive position and a second climbing aid in a passive position, FIG. 12 is a side view of the heel unit according to the third embodiment of the present invention with the first climbing aid in the passive position and the second climbing aid in the passive position, FIG. 13 is a side view of the heel unit according to the third embodiment of the present invention with the first climbing aid in an active position and the second climbing aid in the standby position, FIG. 14 is a side view of the heel unit according to the third embodiment of the present invention with the first climbing aid in the active position and the second climbing aid in an active position, FIG. 15 is a perspective view of a heel unit according to a fourth embodiment of the present invention with a first climbing aid in a passive position and a second climbing aid in a passive position, FIG. 16 is a side view of the heel unit according to the fourth embodiment of the present invention with the first climbing aid in the passive position and the second climbing aid in the passive position, FIG. 17 is a side view of the heel unit according to the fourth embodiment of the present invention with the first climbing aid in a position at a center point of a motion path of the first climbing aid between the passive position and an active position, and FIG. 18 is a side view of the heel unit according to the fourth embodiment of the present invention with the first climbing aid in the active position and the second climbing aid in a standby position.

FIRST EMBODIMENT

FIGS. 1 to 6 show a heel unit 10 according to a first embodiment of the present invention. The heel unit 10 comprises a binding body 12 and a climbing aid 20 which, in particular, can be pivotably mounted on the binding body 12 on a shaft 22. The binding body 12 is suitable for holding a heel portion of an alpine touring shoe (not shown) in a downhill position of the heel unit 10 and for releasing the heel portion of the alpine touring shoe in an alpine touring position of the heel unit 10, such that the alpine touring shoe can lift off the heel unit 10. The climbing aid 20 is adjustable between an active position, which is shown in FIGS. 4 to 6, and a passive position, which is shown in FIGS. 1 and 2. While in the active position, the climbing aid 20 supports the heel portion of the alpine touring shoe at a predetermined height above a sliding board plane in the alpine touring position of the heel unit 10. The climbing aid 20 is biased into the active position over the entire path of movement thereof by means of a flexible element (not shown). The flexible element can be realised, for example, by a leg spring which is arranged on the shaft 22 and transmits a spring force to the binding body 12 and to the climbing aid 20. However, other types of springs or other types of flexible elements are also conceivable in order to bias the climbing aid 20 into the active position. In addition, the climbing aid 20 can be locked in the passive position, for example by means of latching projections or the like.

In the embodiment shown, the climbing aid 20 can be a first climbing aid 20 and, furthermore, a second climbing aid 30 can be provided which is likewise adjustable between an active position and a passive position, wherein, while in the active position, the second climbing aid 30 supports the heel portion of the alpine touring shoe at a predetermined height in the alpine touring position of the heel unit 10, which height is higher than the predetermined height of the first climbing aid 20. The second climbing aid 30 can be pivotably mounted on a shaft 32 on the first climbing aid 20.

The individual drawings show a transition of the climbing aid 20 from the passive position into the active position.

FIGS. 1 and 2 show a perspective view and a side view of the heel unit 10 according to the first embodiment with the first climbing aid 20 in the passive position and the second climbing aid 30 in the passive position. The first climbing aid 20 can be locked in the passive position by means of the second climbing aid 30. A locking can take place, for example, by a latching projection 14 provided on the binding body 12 and a projection 36 provided on the second climbing aid 30, which engages with the latching projection 14. Alternatively, it is possible that a projection provided on the first climbing aid 20 engages into a latching projection provided on the binding body 12 in order to lock the first climbing aid 20 in the passive position. In addition, a plurality of latching projections and projections designed to be complementary thereto can be provided in order to lock the first climbing aid 20 and/or the second climbing aid 30 in the passive position. In the first embodiment, the locking, which takes place via the second climbing aid 30 mounted on the first climbing aid 20, can be released by pressing either on the unlocking extension 38 on the second climbing aid 30 or on the unlocking surface 40 on the second climbing aid 30. This can take place by hand or using a ski pole, for example. In the case of both options, the engagement between the projection 36 and the latching projection 14 and thus the locking of the first climbing aid 20 and the second climbing aid 30 can be released.

FIG. 3 shows a position of the climbing aids 20, 30 shortly after releasing the engagement between the projection 36 and the latching projection 14. Since the first climbing aid 20 is biased into the active position over the entire path of movement thereof, it moves into the active position after releasing the locking. This position is illustrated in FIG. 4. In the alpine touring position of the heel unit 10 in the active position of the first climbing aid 20, the heel portion of the alpine touring shoe can be supported on a support surface 24 of the first climbing aid 20 at the predetermined height above the sliding board plane.

The flexible element can advantageously provide a spring force both for the first climbing aid 20 and for the second climbing aid 30. In the embodiment described, this takes place in that the second climbing aid 30 is mounted on the first climbing aid 20, on which the flexible element in turn acts in the form of the leg spring (not shown). As can be seen in FIG. 4, a mating surface 42 of the second climbing aid 30 is pressed by this spring force against an opposite mating surface 16 of the binding body 12 and the second climbing aid 30 is held in a spring-loaded manner in a standby position in which it protrudes upwards from the binding body 12. As a result, the operation of the second climbing aid 30 or an adjustment of the second climbing aid 30 into its active position can be made considerably easier. The exact position of the standby position of the second climbing aid can be adjusted by means of an angle of the mating surface 16 of the binding body 12.

In order to adjust the second climbing aid 30 into the active position, it only has to be guided from the standby position into the active position, for example by hand or using a ski pole. As soon as an edge between the mating surface 40 and the unlocking surface 42, which can slide over the mating surface 16 of the binding body 12 during this adjustment, exceeds a specific point, the second climbing aid 30 can also be biased into the active position by means of the spring force of the flexible element. This position is shown in FIG. 5 as a side view of the heel unit 10 and in FIG. 6 as a sectional view of the heel unit 10. The unlocking surface 40 of the second climbing aid 30 can be pressed against the mating surface 16 of the binding body 12 in order to hold the second climbing aid 30 in the active position by means of the spring force of the flexible element. In the alpine touring position of the heel unit 10 in the active position of the second climbing aid 30, the heel portion of the alpine touring shoe can be supported on a support surface 34 of the second climbing aid 30 at the predetermined height above the sliding board plane, which height is higher than the predetermined height of the first climbing aid 20.

Second Embodiment

FIGS. 7 to 10 show a heel unit 110 according to a second embodiment of the present invention. The heel unit 110 comprises a binding body 112, a first climbing aid 120 and optionally a second climbing aid 130. The binding body 112 is suitable for holding a heel portion of an alpine touring shoe (not shown) in a downhill position of the heel unit 110 and for releasing the heel portion of the alpine touring shoe in an alpine touring position of the heel unit 110, such that the alpine touring shoe can lift off the heel unit 110. The first climbing aid 120 is adjustable between an active position, which is shown in FIGS. 9 and 10, and a passive position, which is shown in FIGS. 7 and 8. While in the active position, the first climbing aid 120 supports the heel portion of the alpine touring shoe at a predetermined height above a sliding board plane in the alpine touring position of the heel unit 110. The second climbing aid 130 is adjustable between an active position, which is shown in FIG. 10, and a passive position, which is shown in FIGS. 7 and 8. While in the active position, the second climbing aid 130 supports the heel portion of the alpine touring shoe at a predetermined height above a sliding board plane in the alpine touring position of the heel unit 110, which height is higher than the predetermined height of the first climbing aid 120.

The first climbing aid 120 is biased into the active position over the entire path of movement thereof by means of a flexible element (not shown). The flexible element can be realised, for example, by a leg spring, a compression spring or a tension spring. In addition, the first climbing aid 120 can be locked in the passive position, for example by means of latching projections or the like. A locking can take place, for example, by means of a latching projection 114 provided on the binding body 112 and by means of a driver projection 126 provided on the first climbing aid 120, which engages with the latching projection 114. A plurality of latching projections and projections designed to be complementary thereto can also be provided in order to lock the first climbing aid 120 and/or the second climbing aid 130 in the passive position.

The first climbing aid 120 can furthermore be configured to transfer the second climbing aid 130 into a standby position during the adjustment of the first climbing aid 120 from the passive position into the active position, the standby position being located between the passive position and the active position of the second climbing aid 130. In the standby position of the second climbing aid 130, which is shown in FIG. 9, the second climbing aid 130 can advantageously protrude upwards from the binding body 112 and is thus easier to grip or operate, while in the passive position it can advantageously abut close to the binding body 112. In this way, the operation of the second climbing aid 130 is simplified. In addition, a shortened path has to be overcome for the adjustment of the second climbing aid 130 into the active position. In particular in FIGS. 8 and 9, it can be seen that, during the adjustment of the first climbing aid 120 from the passive position into the active position, the first climbing aid 120 can drive said second climbing aid into the standby position via the driver projection 126 which abuts on a surface of the second climbing aid 130.

The first climbing aid 120 can be composed of a first part 120*a* and a second part 120*b*. The first part 120*a* of the first climbing aid 120 can be mounted on the heel unit 110, in particular on the binding body 112, so as to be slidably and linearly displaceable in longitudinal grooves 116 formed in the binding body 112. The second part 120*b* of the first climbing aid 120 can be pivotably mounted on a shaft 122 formed on the first part 120*a* of the first climbing aid 120. Thus, an adjustment of the first climbing aid 120 can be carried out from the passive position into the active position by releasing the locking of the first climbing aid 120, sliding the first part 120*a* of the first climbing aid 120 forward in the longitudinal direction of the ski and pivoting the second part 120*b* of the first climbing aid 120 forward about the shaft 122, whereby the second part can drive the second climbing aid 130 into the standby position. This position is shown in FIG. 9.

A shaft 132 of the second climbing aid 130 can be mounted in grooves 118 formed on both sides of the binding body 112 so as to be longitudinally displaceable in the longitudinal direction of the ski and can also be connected to the first climbing aid 120 via straps 150 formed on both sides. These straps 150 can in particular be mounted at one end on the shaft 122 of the first climbing aid 120 and at an opposite end on the shaft 132 of the second climbing aid 130. For example, this makes it possible for the flexible element to provide a spring force both for the first climbing aid 120 and for the second climbing aid 130.

The individual drawings show a transition of the first climbing aid 120 from the passive position into the active position and a transition of the second climbing aid 130 from the passive position into the standby position and into the active position.

FIGS. 7 and 8 show a perspective view and a side view of the heel unit 110 according to the second embodiment with the first climbing aid 120 in the passive position and the second climbing aid 130 in the passive position.

FIG. 9 is a side view of the heel unit 110 according to the second embodiment with the first climbing aid 120 in the active position and the second climbing aid 130 in the standby position. It can be seen that, in the alpine touring position of the heel unit 110 in the active position of the first climbing aid 120, the heel portion of the alpine touring shoe can be supported on a support surface 124 of the first climbing aid 120 at the predetermined height above the sliding board plane. The second climbing aid 130 protrudes upwards and is easy to grip and use.

FIG. 10 is a side view of the heel unit 110 according to the third embodiment with the first climbing aid 120 in the active position and the second climbing aid 130 in the active position. In the alpine touring position of the heel unit 110 in the active position of the second climbing aid 130, the heel portion of the alpine touring shoe can be supported on a support surface 134 of the second climbing aid 130 at the predetermined height above the sliding board plane, which height is higher than the predetermined height of the first climbing aid 120.

Third Embodiment

FIGS. 11 to 14 show a heel unit 210 according to a third embodiment of the present invention. The heel unit 210 comprises a binding body 212, a first climbing aid 220 and a second climbing aid 230. The binding body 212 is suitable for holding a heel portion of an alpine touring shoe (not shown) in a downhill position of the heel unit 210 and for releasing the heel portion of the alpine touring shoe in an alpine touring position of the heel unit 210, such that the alpine touring shoe can lift off the heel unit 210. The first climbing aid 220 is adjustable between an active position, which is shown in FIGS. 13 and 14, and a passive position, which is shown in FIGS. 11 and 12. While in the active position, the first climbing aid 220 supports the heel portion of the alpine touring shoe at a predetermined height above a sliding board plane in the alpine touring position of the heel unit 210. The second climbing aid 230 is adjustable between an active position, which is shown in FIG. 14, and a passive position, which is shown in FIGS. 11 and 12. While in the active position, the second climbing aid 230 supports the heel portion of the alpine touring shoe at a predetermined height above a sliding board plane in the alpine touring position of the heel unit 210, which height is higher than the predetermined height of the first climbing aid 220. The first climbing aid 220 is configured to transfer the second climbing aid 230 into a standby position during the adjustment of the first climbing aid 220 from the passive position into the active position, the standby position being located between the passive position and the active position of the second climbing aid 230.

In the standby position of the second climbing aid 230, which is shown in FIG. 13, the second climbing aid 230 can advantageously protrude upwards from the binding body 212 and is thus easier to grip or operate, while in the passive position it can advantageously abut close to the binding body 212. In this way, the operation of the second climbing aid 230 is simplified. In addition, a shortened path has to be overcome for an adjustment of the second climbing aid 230 into the active position. In particular in FIGS. 12 and 13, it can be seen that the first climbing aid 220 can have a driver projection 226, which abuts on a surface of the second climbing aid 230 and drives said second climbing aid into the standby position during the adjustment of the first climbing aid 220 from the passive position into the active position.

The first climbing aid 220 and/or the second climbing aid 230 can be mounted pivotably on the heel unit, in particular on the binding body 212. In the third embodiment, both the first climbing aid 220 and the second climbing aid 230 can be mounted on a shaft 222.

Via a resilient projection 240, which can in particular be provided on the binding body 212 and which interacts with the lower ends of the first climbing aid 220 and/or the second climbing aid 230, or via another spring element, the first climbing aid 220 and/or the second climbing aid 230 can be biased into the active position and/or the passive position.

The individual drawings show a transition of the first climbing aid 220 from the passive position into the active position and a transition of the second climbing aid 230 from the passive position into the standby position and into the active position.

FIGS. 11 and 12 show a perspective view and a side view of the heel unit 210 according to the third embodiment with the first climbing aid 220 in the passive position and the second climbing aid 230 in the passive position.

FIG. 13 is a side view of the heel unit 210 according to the third embodiment with the first climbing aid 220 in the active position and the second climbing aid 230 in the standby position. It can be seen that, in the alpine touring position of the heel unit 210 in the active position of the first climbing aid 220, the heel portion of the alpine touring shoe can be supported on a support surface 224 of the first climbing aid 220 at the predetermined height above the sliding board plane. The second climbing aid 230 protrudes upwards and is easy to grip and use.

FIG. 14 is a side view of the heel unit 210 according to the third embodiment with the first climbing aid 220 in the active position and the second climbing aid 230 in the active position. In the alpine touring position of the heel unit 210 in the active position of the second climbing aid 230, the heel portion of the alpine touring shoe can be supported on a support surface 234 of the second climbing aid 230 at the predetermined height above the sliding board plane, which height is higher than the predetermined height of the first climbing aid 220.

Fourth Embodiment

FIGS. 15 to 18 show a heel unit 310 according to a fourth embodiment of the present invention. The heel unit 310 comprises a binding body 312, a first climbing aid 320 and a second climbing aid 330. The binding body 312 is suitable for holding a heel portion of an alpine touring shoe (not shown) in a downhill position of the heel unit 310 and for releasing the heel portion of the alpine touring shoe in an alpine touring position of the heel unit 310, such that the alpine touring shoe can lift off the heel unit 310. The first climbing aid 320 is adjustable between a passive position, which is shown in FIGS. 15 and 16, and an active position, which is shown in FIG. 18. While in the active position, the first climbing aid 320 supports the heel portion of the alpine touring shoe on a support surface 324 at a predetermined height above a sliding board plane in the alpine touring position of the heel unit 310. The second climbing aid 330 is adjustable between a passive position, which is shown in FIGS. 15 and 16, and an active position, not shown. While in the active position, the second climbing aid 330 supports the heel portion of the alpine touring shoe on a support surface 334 at a predetermined height above a sliding board plane in the alpine touring position of the heel unit 310, which height is higher than the predetermined height of the first climbing aid 320.

In the embodiment shown, as in the first embodiment, the first climbing aid 320 can be mounted pivotably on the binding body 312 about shaft 322, and the second climbing aid 30 can be mounted pivotably on the first climbing aid 320 about a shaft 332.

The first climbing aid 320 is further configured to transfer the second climbing aid 330 into a standby position during the adjustment of the first climbing aid 320 from the passive position into the active position, the standby position being located between the passive position and the active position of the second climbing aid 330.

In the standby position of the second climbing aid 330, which is shown in FIG. 18, the second climbing aid 330 can advantageously protrude upwards from the binding body 312 and is thus easier to grip or operate, while in the passive position it can advantageously abut close to the binding body 312. In this way, the operation of the second climbing aid 330 is simplified. In addition, a shortened path has to be overcome for an adjustment of the second climbing aid 330 into the active position.

Further, in the fourth embodiment of the present invention, the first climbing aid 320 is biased into the active position by means of an elastic element (not shown) such as a spring or the like. In particular it is biased into the active position within a specific portion of a motion path of the first climbing aid 320 between the active position and the passive position, and, after passing through a center point of this motion path, it is biased into the passive position in the other part of the remaining portion of the motion path.

FIGS. 16 to 18 show a transition of the first climbing aid 320 from the passive position through the center point into the active position and a transition of the second climbing aid 230 from the passive position into the standby position.

In FIG. 16, both the first climbing aid 320 and the second climbing aid 330 are shown in the passive position. The first climbing aid 320 is biased into the passive position. By pressing on the first climbing aid 320, for example on the support surface 324, the first climbing aid 320 can be moved about the shaft 322 against the biasing force towards the active position.

The center point passage of the first climbing aid 320 is shown in FIG. 17. In the position shown, the elastic element applying a spring force on the first climbing aid 320 is compressed the most, and gradually relaxes again when the first climbing aid 320 moves about the shaft 322 towards the active position beyond this point. Thus, the first climbing aid 320 is initially biased into the passive position, biased into the active position after the center point has been passed, and, due to the biasing force, moves automatically further into the active position shown in FIG. 18. Simultaneously, the second climbing aid 330 is transferred into the standby position, as shown in FIGS. 17 and 18.

In the active position shown in FIG. 18, a surface 325 of the first climbing aid 320, which is provided on a leg of the first climbing aid 320 facing the shaft 322, comes into contact with an opposing surface 315 provided on the binding body 312. This abutment of the surface 325 provided on the leg of the first climbing aid 320 against the surface 315 provided on the binding body 312 defines the active position of the first climbing aid 320.

Embodiments of the present invention have been described with reference to the accompanying drawings. However, the present invention is not limited to these embodiments. Thus, many changes can be made therein without departing from the scope of the present invention. Likewise, the described embodiments can be combined with one another without departing from the scope of the present invention.

The invention claimed is:

1. A heel unit for an alpine touring binding, comprising:

a binding body configured for holding a heel portion of an alpine touring shoe in a downhill position of the heel unit and for releasing the heel portion of the alpine touring shoe in an alpine touring position of the heel unit, such that the alpine touring shoe can lift off the heel unit;

a first climbing aid which is adjustable between a first climbing aid active position and a first climbing aid passive position, wherein, while in the first climbing aid active position, the first climbing aid supports the heel portion of the alpine touring shoe at a first predetermined height above a sliding board plane in the alpine touring position of the heel unit, and wherein the first climbing aid is biased by means of a flexible element and is configured to pass a center point of a motion path between the first climbing aid passive position and the first climbing aid active position during the adjustment of the first climbing aid from the first climbing aid passive position into the first climbing aid active position; and a second climbing aid which is adjustable between a second climbing aid active position and a second climbing aid passive position, wherein, while in the second climbing aid active position, the second climbing aid supports the heel portion of the alpine touring shoe at a second predetermined height above the sliding board plane in the alpine touring position of the heel unit, wherein the second predetermined height is higher than the first predetermined height, wherein the first climbing aid is configured to transfer the second climbing aid into a standby position during the adjustment of the first climbing aid from the first climbing aid passive position into the first climbing aid active position, the standby position being located between the second climbing aid passive position and the second climbing aid active position.

2. The heel unit according to claim 1, wherein the first climbing aid is pivotably mounted on the heel unit.

3. The heel unit according to claim 1, wherein the first climbing aid is pivotably mounted on the binding body.

4. The heel unit according to claim 1, wherein the first climbing aid is mounted on the heel unit so as to be linearly displaceable.

5. The heel unit according to claim 1, wherein the first climbing aid is mounted on the binding body so as to be linearly displaceable.

6. The heel unit according to claim 1, wherein the second climbing aid is mounted on the first climbing aid.

7. The heel unit according to claim 1, wherein the first climbing aid can be locked in the passive position by the second climbing aid.

8. The heel unit according to claim 1, wherein the first climbing aid is biased by means of the flexible element in the first climbing aid passive position; and wherein, when the first climbing aid passes the center point when moving from the first climbing aid passive position towards the first climbing aid active position, the first climbing aid snaps into the first climbing aid active position.

9. The heel unit according to claim 8, wherein the second climbing aid is simultaneously transferred into the standby position when the the first climbing aid snaps into the first climbing aid active position.

10. The heel unit according to claim 1, wherein the first climbing aid is biased by means of the flexible element in the first climbing aid active position; and wherein, when the first climbing aid passes the center point when moving from the first climbing aid active position towards the first climbing aid passive position, the first climbing aid snaps into the first climbing aid passive position.

11. The heel unit according to claim 1, wherein the flexible element is an elastic element that applies a spring force on the first climbing aid; and wherein the center point comprises a point along the motion path where the elastic element is compressed the most relative to other points along the motion path.

12. The heel unit according to claim 11, wherein the elastic element comprises a spring.

13. The heel unit according to claim 1, wherein the second climbing aid protrudes upwards from the binding body while in the standby position and abuts close to the binding body while in the second climbing aid passive position.

* * * * *